United States Patent [19]

Darwent et al.

[11] 4,249,640

[45] Feb. 10, 1981

[54] CORNER POST PLATFORM ASSEMBLY

[75] Inventors: Richard H. Darwent, Hopatcong; George R. Phillips, Hanover; Herman S. Karol, Morris Township, Morris County, all of N.J.

[73] Assignee: Westinghouse Electric Corp., Pittsburgh, Pa.

[21] Appl. No.: 35,169

[22] Filed: May 2, 1979

[51] Int. Cl.[3] ..... B66B 9/00

[52] U.S. Cl. ..... 187/1 R

[58] Field of Search ..... 187/1 R, 95, 8.59, 76, 187/6; 52/30, 283; 248/566

[56] References Cited

U.S. PATENT DOCUMENTS

| | | | |
|---|---|---|---|
| 1,907,967 | 5/1933 | Himes | 187/1 R |
| 2,246,732 | 6/1941 | Hyrmans | 187/1 R |
| 3,342,288 | 9/1967 | Vogel et al. | 187/1 R |

FOREIGN PATENT DOCUMENTS

| | | | |
|---|---|---|---|
| 1136467 | 9/1962 | Fed. Rep. of Germany | 187/1 R |

*Primary Examiner*—Stanley H. Tollberg
*Assistant Examiner*—Kenneth Noland
*Attorney, Agent, or Firm*—D. R. Lackey

[57] ABSTRACT

A corner post platform assembly for supporting an elevator cab having door openings in two adjacent wall portions, including a safety brake assembly, a support frame, and a floating platform. The safety assembly includes mounting plate members at its opposite ends, upon which the support frame is mounted, and the floating platform is connected to the support frame via resilient spacer and mounting devices.

9 Claims, 5 Drawing Figures

CORNER POST PLATFORM ASSEMBLY

BACKGROUND OF THE INVENTION

1. Field of the Invention

The invention relates in general to elevator cars, and more specifically to elevator cars in which the passenger cab has door openings in two adjacent wall portions.

2. Description of the Prior Art

Elevator systems of the traction type include a drive machine, an elevator car, and a counterweight. The elevator car and counterweight are each guided throughout their respective vertical travel paths in a hoistway of a building via guide roller assemblies mounted on the elevator car and counterweight, and guide rails in the hoistway. A safety brake on the bottom of the elevator car is arranged to be tripped by a governor upon a predetermined overspeed condition. The safety brake, when tripped, engages the elevator guide rails, and stops the elevator car.

The elevator car has a generally rectangular configuration in cross section, with the guide rails conventionally being disposed adjacent to opposite sides thereof, at the midpoints of these sides. The safety brake, which includes two safety channels or planks, extends between the guide rails, and thus its longitudinal axis is oriented perpendicular to the planes which include the side portions of the elevator car. The safety channels form part of the support structure for the elevator passenger cab.

The elevator car structure described to this point will accommodate front and rear door openings in the passenger cab. When front and side door openings in the passenger cab are specified, the conventional guide rail placement cannot be used as one of the guide rails would interfere with a side door opening. Thus, the guide rails are located at two diagonally opposite corners of the rectangular configuration of the elevator car, and the safety brake and its safety channels are oriented diagonally, relative to the passenger cab, in order to extend between the corner-mounted guide rails. This arrangement is referred to as the corner post platform and elevator car structure, because the vertical stiles which extend from the safety channels to the crosshead beam are at the corners of the elevator car.

When the safety brake assembly is diagonally oriented, the platform structure which is mounted on the safety assembly, has two unsupported corners. Thus, a much larger moment is created because of the greater distance between the corners and safety channels, than when the safety channels are in the more conventional location. In order to support these corners, and to prevent flexing of the platform, it is common prior art practice to mount two additional channels on top of the safety channels, with these additional channels being oriented between the two diagonally opposite corners which are not supported by the safety channels. This arrangement, however, adds additional weight and cost to the structure. It also adds about 10 inches to the support structure height below the floor level of the platform, necessitating a deeper pit, which in some installations may present a problem. Further, the resilient isolating pads which are used to mount the platform to the support structure must be placed at two different elevations, i.e., at the level of the first set, or safety, channel members, and at the level of the second, or additional, set of channel members. This arrangement, through localized bending of the channels, platform, and isolation pads, still results in deflection of the two corners of the platform which are not directly over the safety channels.

SUMMARY OF THE INVENTION

Briefly, the present invention is a new and improved corner post platform assembly which is lighter, more rigid, less costly, and lower in vertical height, than corner post platforms of the prior art. First and second plate members, hereinafter referred to as safety plates, are attached to the conventional safety assembly, which includes two spaced safety channels and a safety brake. The safety plates, which are disposed adjacent to the ends of the safety assembly, each include flat mounting surfaces having two "arms" or portions which extend outwardly beyond the edges of the safety channels. These arms include elongated openings or slots. A support frame constructed of four angle members arranged to define a substantially rectangular outer configuration, is attached to the safety plates via bolts which extend through leg portions of the support frame and through the elongated openings in the "arms" of the safety plates. The longitudinal axis of the safety assembly extends between diagonally opposite corners of the support frame, with the elongated openings being oriented to allow a small rotational adjustment of the support frame relative to the safety assembly, which will enable the two door openings in the passenger cab to be properly aligned with, and spaced from, the associated hoistway door openings.

The leg portions of the two angle members disposed at opposite sides of the rectangular support frame are upstanding, in order to prevent interference with the safety assembly. The leg portions of the remaining two angle members are depending, in order to prevent interference with floor beams which reinforce a floating platform assembly.

The floating platform assembly includes a floor member having first and second flat, major opposed surfaces, with side beams disposed about its periphery on the second major side, and a plurality of spaced, parallel floor beams which are also attached to the second major surface of the floor member. This platform assembly is mounted on the support frame via a plurality of resilient isolation pads. The two upstanding leg portions of the angle members extend into the cavity defined by the depending side beams on the floor member, between the side beams and a floor beam, thus meshing or interleaving portions of the support frame and platform assembly, to reduce the vertical dimension of the assembly.

If the safety assembly does not include mounting brackets or angles for mounting the vertically oriented stiles, the safety plates may include depending portions which extend over the adjacent end of the safety assembly, with the stile mounting angles being secured to these depending portions.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF PREFERRED EMBODIMENT

Figure 1:
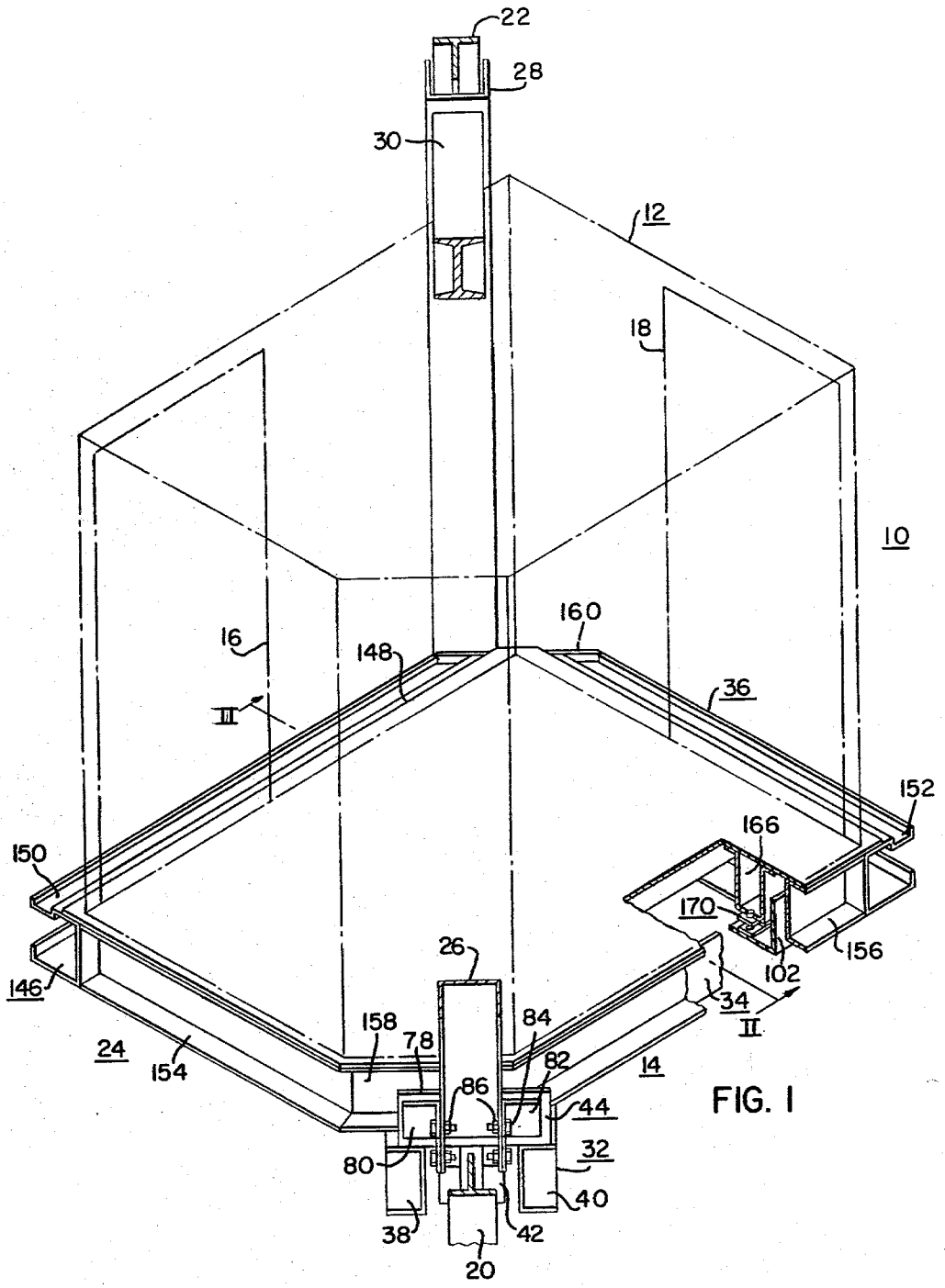
FIG. 1 is a perspective view, shown partially cutaway and partially in phantom, of an elevator car structure having openings in adjacent wall portions of the elevator cab, with the associated corner post platform assembly of the elevator car being constructed according to the teachings of the invention.

Referring now to the drawings, and to FIG. 1 in particular, there is shown an elevator car 10 which includes a passenger cab 12 and a corner post platform assembly 14. The passenger cab 12 includes front and side door openings 16 and 18, respectively, in two adjacent wall portions, thus necessitating the corner post platform assembly 14, wherein the guide rails 20 and 22 are disposed at diagonally opposite corners of the elevator car 10.

The corner post platform assembly 14, which is constructed according to the teachings of the invention, includes a base portion 24 for supporting the passenger cab 12, first and second vertically extending corner posts or stiles 26 and 28, which have their lower ends fixed to the base portion 24, and a crosshead beam 30 which extends between, and is fixed to, the upper ends of stiles 26 and 28.

Figure 2:
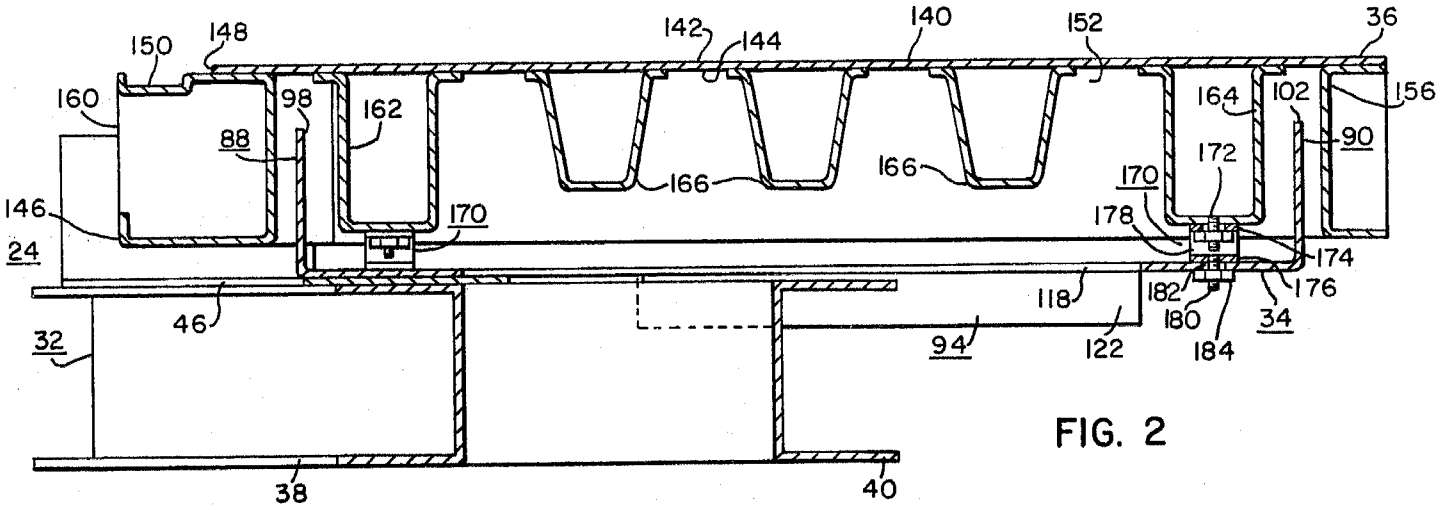
FIG. 2 is a cross-sectional view of the corner post platform assembly shown in FIG. 1 taken between and in the direction of arrows II—II.
Figure 3:
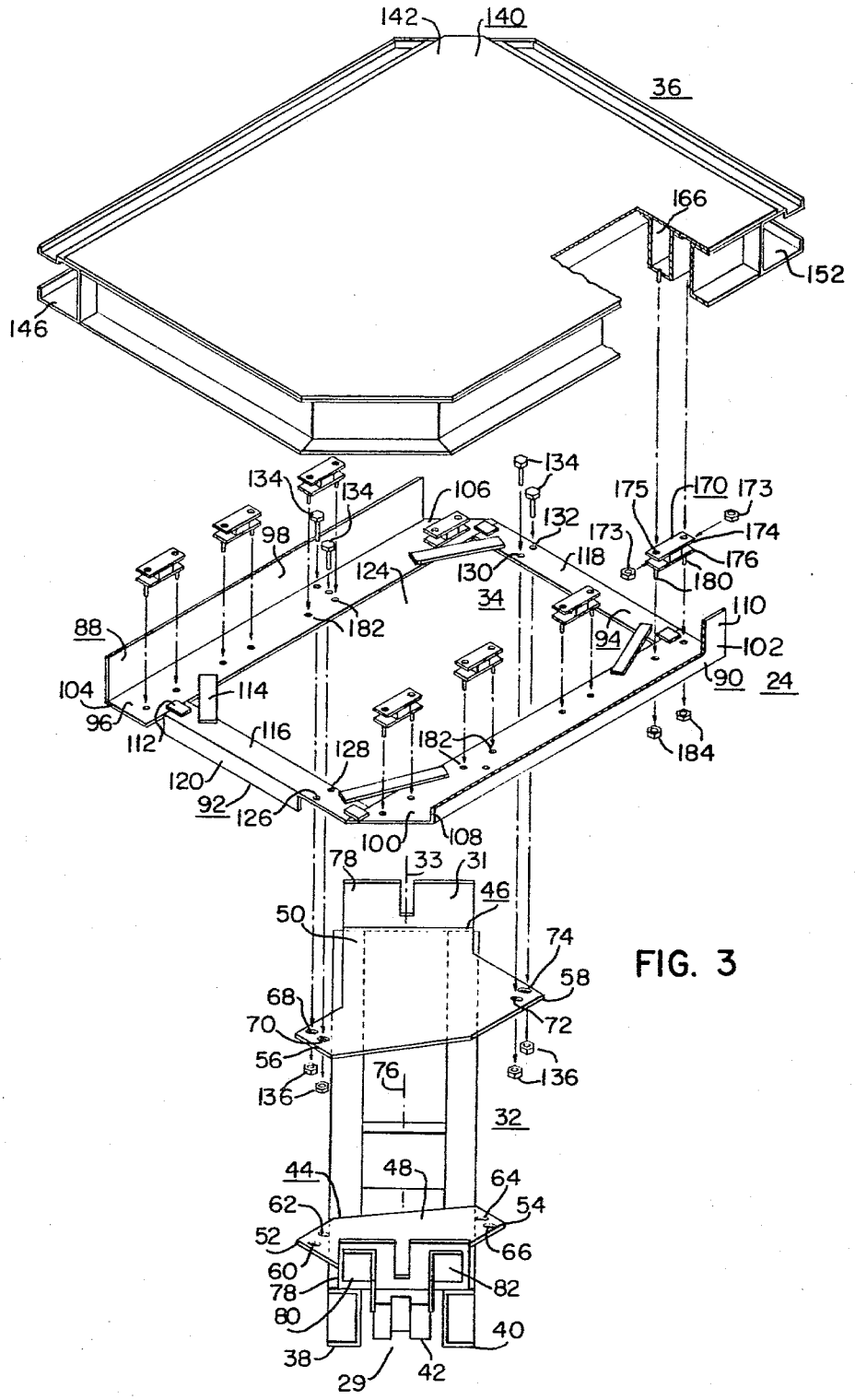
FIG. 3 is an exploded, overall perspective view of the corner post platform assembly shown in FIG. 1.
Figure 3A:
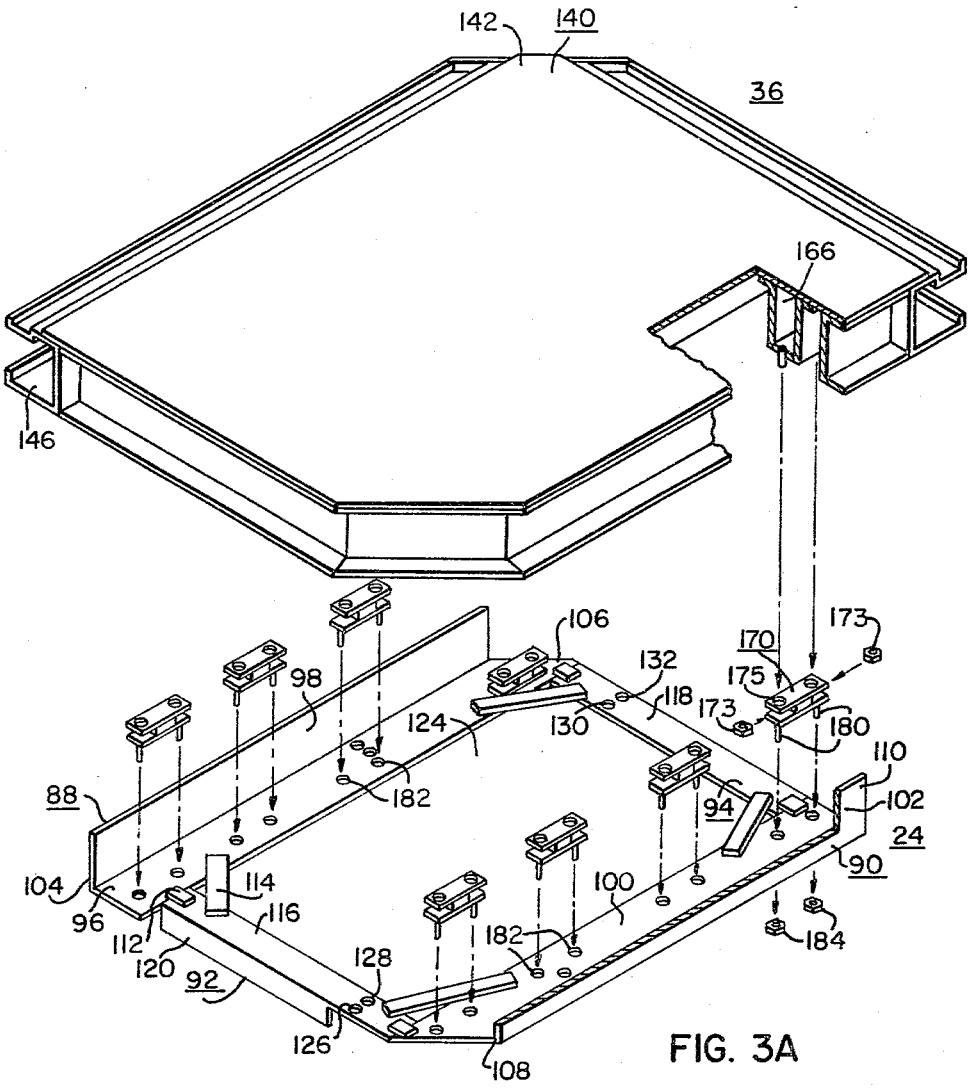
FIGS. 3A and 3B illustrate enlarged portions of the exploded perspective view of the corner post platform assembly shown in FIG. 3, which more clearly set forth the details thereof.
Figure 3B:
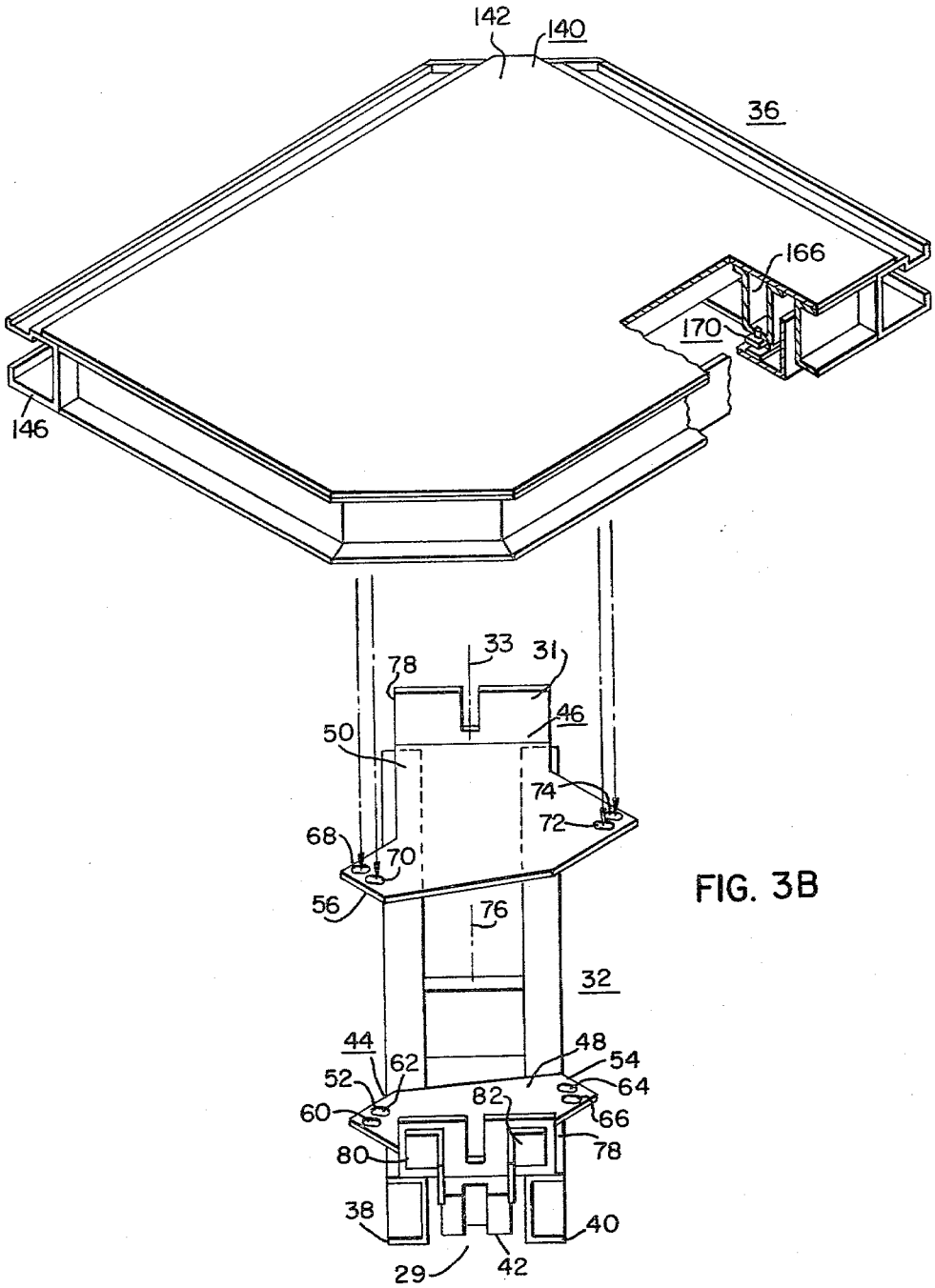

FIGS. 2, 3, 3A and 3B more clearly illustrate the construction of base portion 24, with FIG. 2 being a cross-sectional view of base 24 taken between and in the direction of arrows II—II, and with FIGS. 3, 3A and 3B being exploded perspective views of base 24. All of the Figures will be referred to in the following description.

Base portion 24 includes a safety assembly 32, a support frame 34, and a "floating" platform assembly 36. The safety assembly 32 is an elongated structure having first and second ends 29 and 31, respectively, and a longitudinal axis 33 which extends between its ends. Safety assembly 32 includes the conventional set of safety planks or channel members, such as first and second spaced channel members 38 and 40, and a safety brake 42 disposed between the spaced safety channels. U.S. Pat. No. 3,768,597, which is assigned to the same assignee as the present application, discloses a safety brake of the type which may be used with the teachings of the invention, but any conventional safety brake may be used. The conventional safety assembly is modified, according to the teachings of the invention, to include first and second plate members 44 and 46, respectively, also referred to as safety plates 44 and 46. The safety plates 44 and 46 are disposed adjacent to the first and second ends 29 and 31, respectively, of the safety assembly 32. Safety plates 44 and 46 are secured to the upper portion of the conventional safety assembly, such as by welding the safety plates 44 and 46 to the upper surfaces of the leg portions of the safety channels 38 and 40.

It is essential that the safety plates 44 and 46 include flat major surfaces 48 and 50, respectively, disposed in a common horizontal plane, which surfaces extend outwardly beyond the safety channels 38 and 40 to form mounting "arms," such as mounting arms 52 and 54 on safety plate 44, and mounting arms 56 and 58 on safety plate 46. Each mounting arm includes two elongated openings or slots, such as openings 60 and 62 in arm 52, openings 64 and 66 in arm 54, openings 68 and 70 in arm 56, and openings 72 and 74 in arm 58. The elongated openings are oriented such they provide rotational adjustment of the structure mounted on the safety plates, about a vertical, central axis 76 of the safety assembly 32.

Certain conventional safety brakes include mounting brackets or angles at opposite ends to which the stiles 26 and 28 may be attached, while other safety brakes require that such mounting brackets be attached thereto. If the safety plates 44 and 46 are to be associated with the latter type of safety brake, each may include an integral, upstanding portion, such as portion 78 on safety plate 44, which includes mounting brackets or angle members 80 and 82 fixed thereto, such as by welding or by nut and bolt assemblies. As shown in FIG. 1, fasteners, such as a bolt 84 and a nut 86, may be used to secure the stiles to the mounting brackets.

Support frame 34 includes first and second right angle members 88 and 90, respectively, also referred to as side angles, and third and fourth right angle members 92 and 94, respectively, also referred to as tie angles. Side angle 88 includes first and second leg portions 96 and 98, respectively, with the first leg portion 96 being horizontally oriented, and with the second leg portion 98 extending vertically upward from the horizontal leg portion 96. In like manner, side angle 90 includes a horizontally oriented leg portion 100, and an upstanding leg portion 102. Side angles 88 and 90 each have first and second ends, such as first and second ends 104 and 106 on side angle 88, and first and second ends 108 and 110 on side angle 90. Side angles 88 and 90 are disposed in spaced, parallel relation, with tie angle 92 extending between the first ends 104 and 108 of the side angles, and with the tie angle 94 extending between the second ends 106 and 110. The four angle members are secured in this window-frame configuration, such as by welding, with appropriate clips and straps, 112 and 114, respectively, being welded to the upper surfaces of adjacent side and tie angles, in order to reinforce the weldment. The tie angles 92 and 94 each include horizontally oriented leg portions, such as leg portions 116 and 118, respectively, and depending leg portions 120 and 122, respectively. The vertically oriented leg portions on the tie angles are depending in order to prevent interference with floor beams of the floating platform assembly 36, as will be hereinafter explained.

The support frame 24 thus provides a strong, rigid assembly which has a generally rectangular outer configuration, with its sides all being equal, i.e, a square, or with adjacent sides being unequal, i.e., a rectangle. The angles further define a central opening or window portion 124.

The horizontally oriented leg portions of the side and tie angles of the support frame 24 include a plurality of openings which are to be aligned with the elongated openings in the safety plates, such as openings 126 and 128 through horizontal leg portion 116 of tie angle 92 which are to be aligned with elongated openings 60 and 62, respectively, in safety plate 44, and openings 130 and 132 in leg portion 118 of tie angle 94 which are to be aligned with elongated openings 72 and 74, respectively, in safety plate 46. The openings in the horizontal portions 96 and 100 of side angles 88 and 90, respectively, which are to be aligned with openings 68 and 70, and openings 64 and 66, are not shown.

The support frame 24 is secured to the safety plates 44 and 46 via eight nut and bolt assemblies, such as bolt 134 which is to extend through aligned openings 126 and 60, and nut 136. As hereinbefore mentioned, the elongated openings are oriented to permit rotational adjustment of the support frame and floating platform, in order to provide quick and easy orientation of the door openings in the passenger cab with the associated openings in the hoistway. It will be noted that the longitudinal axis 33 of the safety assembly 32 extends between diagonally opposite corners of the support frame, and thus between guide rails 20 and 22, as shown in FIG. 1.

Floating platform assembly 36 includes a floor member 140 having first and second major opposed, horizontally oriented flat surfaces 142 and 144, respectively, with its major surfaces being joined via perpendicularly oriented edges. Its edges define a substantially rectangular outer configuration, which is generally the same configuration as the rectangular configuration of the support frame 24, except slightly larger.

Platform assembly 36 includes a plurality of beam members welded thereto. For example, a front beam 146 is secured adjacent to the edge 148 on the side of door opening 16. The front beam 146 contacts the second major surface 144 of the floor member, and it extends outwardly past edge 148. The portion which extends outwardly past edge 148 includes a formed portion 150 for receiving an extruded aluminum sill configured to accept the door gib associated with door opening 16. In like manner, a similar beam member 152 is fixed to floor member 140 along the edge which is adjacent to the door opening 18 in the passenger cab 12. C-shaped beam members 154 and 156 are fixed to the second surface 144 adjacent to the remaining two major edges of the floor member. Beam members 154 and 156 do not extend past their associated edges of the floor member, as these edges are not associated with door openings. The corners of the floating platform adjacent to the stiles 26 and 28 are cut off. A short C-shaped beam 158 may be fixed to floor member 140 adjacent to stile 26, and a plate member 160 may be disposed across the cut-off corner adjacent to stile 28.

As best shown in FIG. 2, a plurality of floor beams are also fixed in spaced, parallel relation to the second major surface 144 of floor member 140. These floor beams include first and second side beam members 162 and 164, respectively, and a plurality of additional floor beam members 166 disposed intermediate the first and second side beam members. The side beam members 162 and 164 are dimensioned, in the vertical direction, as viewed in FIG. 2, to enable them to function as part of the mounting structure. As will be hereinafter explained, they cooperate with a plurality of resilient, isolating pad members 170 to provide the "floating" aspect of the platform. A plurality of studs 172 are welded to the lower surfaces of the side floor beams 162 and 164. Each pad member 170 includes upper and lower metallic plate members 174 and 176, disposed in spaced relation, with a block 178 of resilient material disposed between and fixed to the spaced plate members 174 and 176. The block of resilient material may be any suitable material, such as rubber or polyurethane. The upper plate member 174 includes a pair of holes or openings 175 for receiving studs 172, and the lower plate member 176 includes a pair of depending threaded stud portions 180. The horizontal leg portions 96 and 100 of the side angle members 88 and 90 each include a plurality of spaced, elongated openings 182. The pad members 170 are attached to the threaded, depending studs 172 via nuts 173, and the depending studs 180 of the isolating pad members 170 are aligned with the elongated openings 182 and inserted therethrough. Nuts 184 are coupled with the studs 180 to secure the floating platform 36 to the support frame 34 without any direct metallic connection or contact. The openings are elongated in a direction perpendicular to the planes of the upstanding leg portions 98 and 102 of the side angles 88 and 90, respectively, to permit adjustment of the floating platform in this direction.

It should be noted that the upstanding leg portions 98 and 102 of the side angles extend into the cavity defined by floor member 140 and the perimetrical beams of the platform assembly 36. Thus, the upstanding leg portions do not add to the height dimension of the base portion 24. The upstanding leg portions are interleaved between the side floor beams and the adjacent perimetrical beams, with leg portion 98 being disposed between front beam 146 and side floor beam 162, and leg portion 102 is disposed between the rear beam 156 and the side floor beam 164.

The tie angles are oriented perpendicular to the longitudinal dimension of the floor beams, and thus their vertically oriented leg portions are directly downwardly in order to preclude any interference. They do not add to the height dimension of the base portion 24, however, as they do not extend below the lower edges of the safety channels 38 and 40.

In summary, there has been disclosed a new and improved corner post elevator car structure which has a base portion having approximately the same height dimension as the base portion of the more conventional side post car structures. Further, the new and improved corner post elevator car structure is rigid, providing adequate support at the corners which are not disposed over the safety assembly, precluding objectionable deflection at these corners when the passenger cab is loaded.

We claim as our invention:

1. A corner post platform for supporting an elevator cab having door openings in two adjacent wall portions, comprising:

a safety assembly having first and second ends, and a longitudinal axis which extends between its ends, said safety assembly including first and second spaced channel members, which extend between the first and second ends, and first and second plate members adjacent to the first and second ends, respectively, which define first and second flat surfaces disposed in a common horizontal plane, said first and second plate members each including first and second portions which extend outwardly beyond the first and second spaced channel members, respectively, a support frame including first, second, third and fourth angle members, said first and second angle members each having first and second ends, said first and second angle members being disposed in spaced, parallel relation, with the third angle member extending between the first ends of the first and second angle members, and with the fourth angle member extending between the second ends of the first and second angle members, to define a generally rectangular outer configuration, and a central opening, means fastening said support frame to the first and second surfaces of said first and second plate members, with the longitudinal axis of the safety assembly being oriented to extend between two diagonally opposite corners of said support frame, said support means including fastener devices which connect the first and second portions of the first plate member to the third and second angle members, respectively, and fastener devices which connect the first and second portions of the second plate member to the first and fourth angle members, respectively, a platform assembly including a floor member having first and second flat major opposed surfaces, the edges of which define a generally rectangular configuration, and at least first and second spaced, parallel floor beam members fixed to the second major surface of said floor member, and resilient means fastening said platform assembly to said support frame, with said resilient means including a plurality of discrete resilient members disposed between said first floor beam member and said first angle member, and between said second floor beam member and said second angle member.

2. The corner post platform of claim 1 wherein the safety assembly includes a safety brake disposed between said channel members which is operable to engage elevator guide rails, with the first and second plate members being fixedly attached to said first and second spaced channel members.

3. The corner post platform of claim 1 wherein the fastener devices include elongated members which extend through cooperatively aligned openings in the plate and angle members, with at least certain of the openings being elongated to permit rotational adjustment of a support frame about a vertical axis, relative to the safety assembly.

4. The corner post platform of claim 1 including first and second upstanding stile members fixed to the first and second ends of the safety assembly, and a crosshead member fixed between the upstanding ends of said first and second stile members.

5. The corner post platform of claim 4 wherein the first and second plate members include depending portions, and means joining said depending portions to the first and second stile members, respectively.

6. The corner post platform of claim 1 wherein the resilient members include upper portions attached to the first and second floor beam members, and depending threaded portions which extend through openings in the first and second angle members, with said openings being elongated to provide adjustment of the platform assembly relative to the support frame.

7. A corner post platform for supporting an elevator cab having door openings in two adjacent wall portions, comprising:

a safety assembly having first and second ends, and a longitudinal axis which extends between its ends, said safety assembly including first and second plate members adjacent to its first and second ends, respectively, which define first and second flat surfaces disposed in a common horizontal plane, a support frame including first, second, third and fourth angle members, said first and second angle members each having first and second ends, said first and second angle members being disposed in spaced, parallel relation, with the third angle member extending between the first ends of the first and second angle members, and with the fourth angle member extending between the second ends of the first and second angle members, to define a generally rectangular outer configuration, and a central opening, means fastening said support frame to the first and second surfaces of said first and second plate members, with the longitudinal axis of the safety assembly being oriented to extend between two diagonally opposite corners of said support frame, a platform assembly including a floor member having first and second flat major opposed surfaces, the edges of which define a generally rectangular configuration, at least first and second spaced, parallel floor beam members fixed to the second major surface of said floor member, and a plurality of outer beam members fixed to the second major surface of the floor member, adjacent to its edges, to define a cavity having a substantially rectangular cross-sectional configuration, and resilient means fastening said platform assembly to said support frame, with the upstanding leg portions of said first and second angle members of the support frame extending into the cavity of the platform assembly, between a floor beam member and an outer beam member thereof, said resilient means including a plurality of discrete resilient members disposed between said first floor beam member and said first angle member, and between said second floor beam member and said second angle member.

8. A corner post platform for supporting an elevator cab having door openings in two adjacent wall portions, comprising:

a safety assembly having first and second ends, and a longitudinal axis which extends between its ends, said safety assembly including first and second plate members adjacent to its first and second ends, respectively, which define first and second flat surfaces disposed in a common horizontal plane, a support frame including first, second, third and fourth right angle members each having a horizontally oriented leg portion, and a vertically oriented leg portion, said first and second angle members each having first and second ends, said first and second angle members being disposed in spaced, parallel relation, with the third angle member extending between the first ends of the first and second angle members, and with the fourth angle member extending between the second ends of the first and second angle members, to define a generally rectangular outer configuration, and a central opening, means fastening said support frame to the first and second surfaces of said first and second plate members, with the longitudinal axis of the safety assembly being oriented to extend between two diagonally opposite corners of said support frame, a platform assembly including a floor member having first and second flat major opposed surfaces, the edges of which define a generally rectangular configuration, and at least first and second spaced, parallel floor beam members fixed to the second major surface of said floor member, said third and fourth angle members of the support frame being oriented perpendicular to the floor beam members, with their vertically oriented portions depending to avoid interference with the floor beam members, and with the horizontal leg portions of said first and second angle members being disposed to cross the safety assembly, with their vertically oriented portions upstanding to avoid interference with the safety assembly, and resilient means fastening said platform assembly to said support frame, with said resilient means including a plurality of discrete resilient members disposed between said first floor beam member and said first angle member, and between said second floor beam member and said second angle member.

9. The corner post assembly of claim 8 wherein the platform assembly additionally includes a plurality of outer beam members fixed to the second major surface of the floor member, adjacent to its edges, to define a cavity having a substantially rectangular cross-sectional configuration, and wherein the upstanding leg portions of the first and second angle members extend into said cavity, between a floor beam member and an outer beam member of the platform assembly.

* * * * *